US006612860B2

(12) United States Patent
Droesbeke

(10) Patent No.: US 6,612,860 B2
(45) Date of Patent: Sep. 2, 2003

(54) CABLE CONNECTOR AND KIT FOR MAKING A CABLE CONNECTOR

(75) Inventor: Gert Droesbeke, Nijlen (BE)

(73) Assignee: Framatone Connectors International, Courbevoie (FR)

( * ) Notice: Subject to any disclaimer, the term of this patent is extended or adjusted under 35 U.S.C. 154(b) by 0 days.

(21) Appl. No.: 09/922,346

(22) Filed: Aug. 3, 2001

(65) Prior Publication Data

US 2002/0052136 A1 May 2, 2002

(30) Foreign Application Priority Data

Aug. 11, 2000 (NL) ..... 1015918

(51) Int. Cl.[7] ..... H01R 13/627
(52) U.S. Cl. ..... 439/357; 439/352
(58) Field of Search ..... 439/352, 357, 439/350, 355, 358, 371, 372

(56) References Cited

U.S. PATENT DOCUMENTS 5,142,777 A * 9/1992 Boyer et al. ..... 29/884
5,282,621 A * 2/1994 Tseng ..... 273/148
5,613,870 A * 3/1997 Traver, Jr. ..... 439/355

FOREIGN PATENT DOCUMENTS

| | | |
|---|---|---|
| DE | 4016890 A1 | 11/1991 |
| EP | 0285860 A2 | 10/1988 |
| EP | 0519577 A2 | 12/1992 |
| EP | 0801446 A1 | 10/1997 |

* cited by examiner

*Primary Examiner*—Jean F. Duverne
(74) *Attorney, Agent, or Firm*—Perman & Green, LLP

(57) ABSTRACT

There is disclosed a cable connector including a housing of an electrically insulating material containing one or more contact elements, one or more openings for accommodating a corresponding number of cables, and a means for establishing a connection to a counterpart, such as a header soldered to a printed circuit board. The means comprises a resilient latch which in turn comprises a guide with which the latch is fitted, preferably by means of sliding, into or onto a complementary guide, such as a groove or rail, on the housing.

15 Claims, 2 Drawing Sheets

CABLE CONNECTOR AND KIT FOR MAKING A CABLE CONNECTOR

BACKGROUND OF THE INVENTION

1. Field of the Invention

The invention pertains to a cable connector comprising a housing of an electrically insulating material containing one or more contact elements, one or more openings for accommodating a corresponding number of cables and a means for establishing a connection to a counterpart, such as a header soldered to a printed circuit board (PCB).

2. Description of Prior Development

Cable connectors of this kind are know, for instance from European patent application EP 0 801 446. This patent publication concerns a connector of the shielded type comprising a socket attached to a PCB and a plug designed to be mechanically and electrically coupled to the socket. One wall of the socket is covered with a shielding of electrically conducted material. This shielding is extended on its front part by projections folded back on themselves so as to form a spring, these springs emerging inside the socket and exerting a pushing force on the plug along a direction orthogonal to the direction of insertion of the plug into the socket, so as to establish a galvanic contact with the shielding of the plug.

SUMMARY OF THE INVENTION

It is an object of the present invention to provide a cable connector, especially a high speed cable connector, that is modular in nature and allows relatively uncomplicated assembly.

To this end, the cable connector according to the first paragraph is characterised in that the means for establishing a connection to a counterpart comprise a resilient latch which in turn comprises a guide with which the latch is fitted, preferably by means of sliding, into or onto a complimentary guide, such as a groove or rail, on the housing.

It is preferred that the cable connector comprises a stack of at least two of the said housings with the guide or the latch being fitted at least into or onto complimentary guides on the outermost housings.

The cable connectors according to the present invention can be assembled more easily using one or more modules.

The cable connector preferably comprises at least one coding pin which is sandwiched between the resilient latch and the housing. It is further preferred that the said housing comprises at least one cavity in which the coding pin is or can be placed, the cavity and one end or a section of the coding pin having corresponding cross-sections which enable placement of the pin in the cavity in one of a number of different positions. In this respect it is preferred that a top view of the other end of the coding pin is different for each of the said positions. As will be explained below, the said cavities and coding pin(s) provide(s) a large number of permutations and combinations for coding the cable connector and hence avoiding inadvertently misplacing a cable connector e.g. in a header where it does not belong.

The invention further pertains to a kit comprising contact elements, housings of an electrically insulating material containing one or more cavities for accommodating a corresponding number of contact elements and one or more openings for accommodating a corresponding number of cables, wherein the kit further comprises a resilient latch which in turn comprises a guide with which the latch can be fitted, preferably by means of sliding, into or onto a complementary guide(s), such as a groove or rail, on the housing or on the outermost housings of a stack of housings.

BRIEF DESCRIPTION OF THE DRAWINGS

The invention will be further explained with reference to the drawings in which a preferred modular high speed cable connector in accordance with the present invention is schematically shown.

DESCRIPTION OF THE PREFERRED EMBODIMENTS

Figure 2:
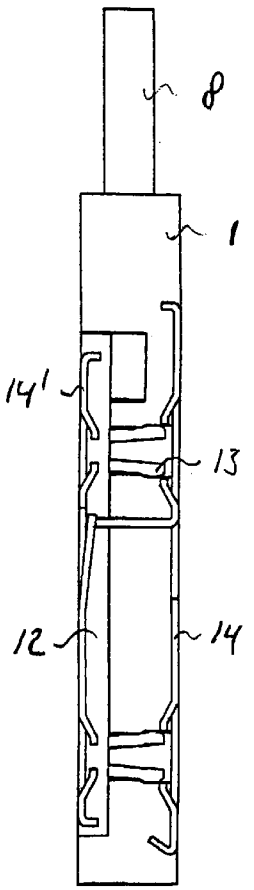
FIG. 2 shows a cross-section through an assembled connector module similar to that of FIG. 1.
Figure 1:
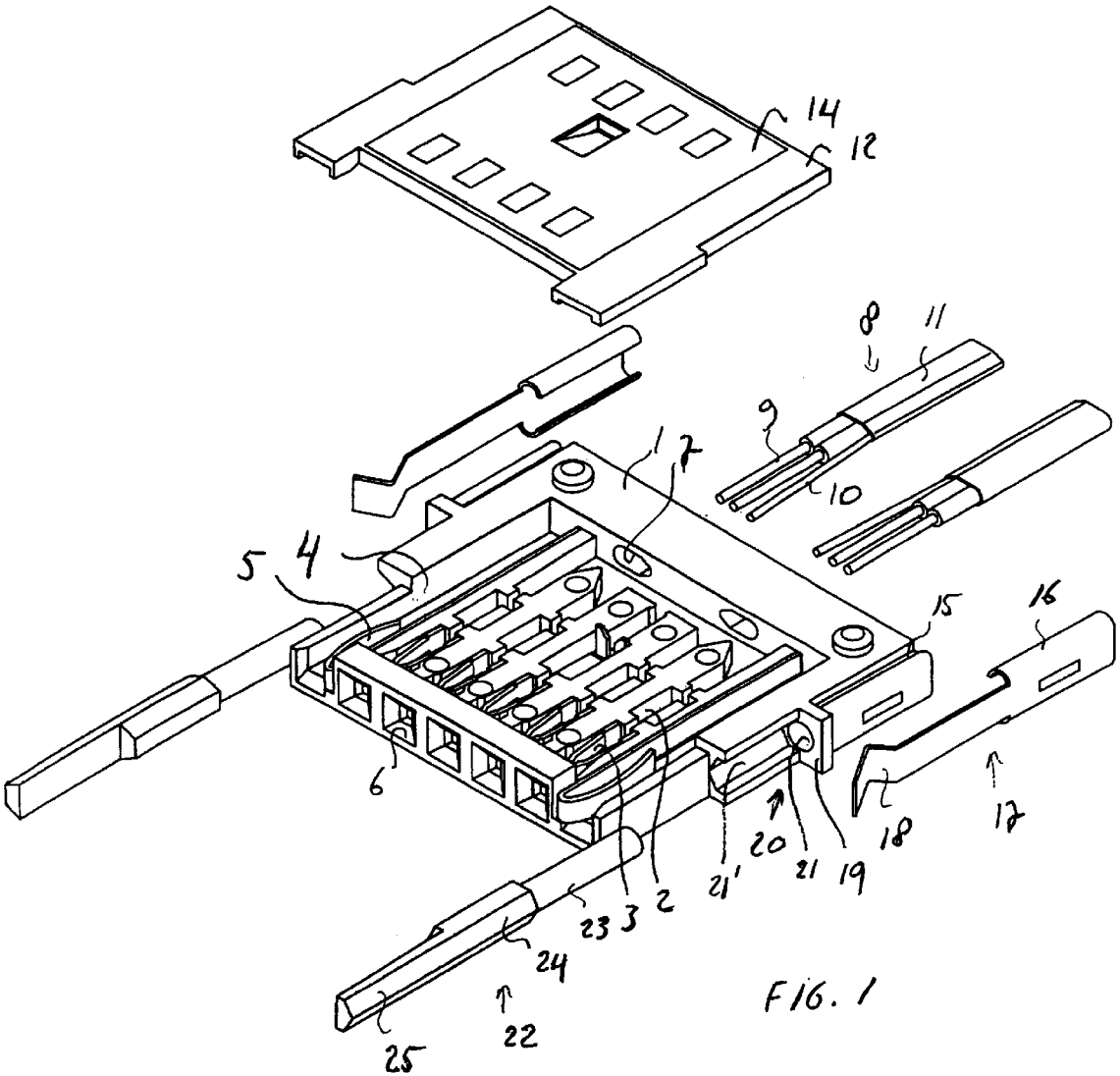
FIG. 1 is an exploded view of a cable connector comprising a single connector module.

FIG. 1 shows a cable connector module according to the present invention comprising a housing 1 of an electrically insulating material, such a polyamide or a liquid crystalline polymer. The housing 1 comprises, at least in this specific example, five cavities 2 for accommodating receptacle terminals 3 and two cavities 4 for accommodating ground contacts 5. The cavities 2, 4 are associated with openings 6 in the front side of the housing 1 for receiving electrical connector pins which are part of a header (such as for instance shown in FIG. 3). The housing 1 further comprises openings 7 in its rear side for accommodating cables 8. The shown cables 8 each comprise a differential pair 9, a ground 10, which are both fitted in a aluminium foil 11, which serves as a shielding against electromagnetic interference (EMI), and an outer jacket (not shown). The differential pairs 9 and the grounds 10 are, upon assembly of the cable connector, attached to the respective contact elements 3, 5. The cable connector module further comprises a cover 12 which can be snap-fitted into the upper side of the housing 1 by means of resilient diverging legs 13 as shown in FIG. 2. FIG. 2 further shows that the entire cable connector module comprises a, partly embedded, metal shielding 14, 14'.

A pair of parallel guide grooves 15 is provided on either side of the housing 1 (parallel to the insertion direction of the cable connector) for receiving twin guide rails 16 which are part of a latch 17. The latch 17 is made of a resilient metal and further comprises a V-shaped bent portion 18 for establishing a passive snap-fit connection with a complementary notch or groove on a header, as will be discussed below. The latches 17 can be securely attached to the housing 1 simply by sliding the guides 16 into the grooves 15 until the said guides 16 abut a stop 19 on the housing 1.

The housing 1 further comprises two cavities 20 consisting of a cylindrical hole 21 and a semi-polygonal, in this case a semi-hexagonal, groove 21' for receiving a coding pin 22 sandwiched between the latches 17 and the housing 1. The coding pin 22 comprises a cylindrical end 23 which fits into the cylindrical hole 21, an intermediate section 24 having a hexagonal cross-section which can be placed in six different positions in the groove 21' and a semi-hexagonal end 25 for co-operation with a counter coding means associated with a header. The cavities 20 are rotated with respect to each other over an angle of 30°.

Figure 3:
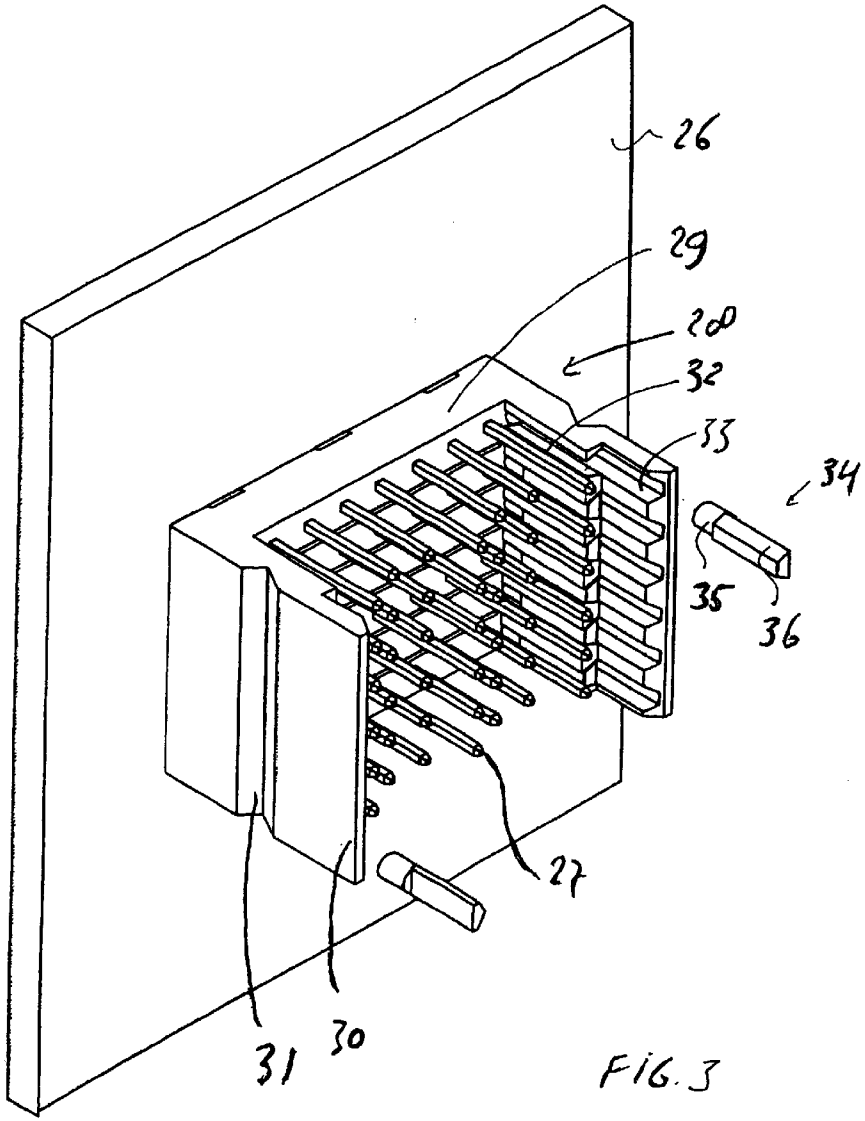
FIG. 3 shows a substrate provided with a header for receiving one or more cable connectors.

FIG. 3 shows a header which is part of a back plane 26 and which, again in this particular example, comprises an array of e.g. 6×7 pins 27. A U-shaped shroud 28 comprising a base plate 29 and two parallel wall 30 is placed over and attached to the pins 27. Each of these walls 30 is provided with a V-groove 31 on its outer surface which runs substantially parallel to the back plane 26 and which is complementary to the bent portion 18 of the latches 17 and allows passive (dis)connection of a cable connector comprising one or more connector modules and two latches 17, 17' as shown in FIG. 4.

Cavities consisting of a cylindrical hole, an open polygonal section 32 and a semi-polygonal groove 33, are provided in the inner surface of the walls 30 on either side of each of the six rows of pins 27. The cavities runs substantially perpendicular to the back plane 26 and may contain a counter coding pin 34. The counter coding pin 34 comprises a cylindrical end 35, which can be placed into the cylindrical hole, and a semi-hexagonal end 36, which can be placed in six different positions in the open polygonal section 32 of the cavities in the shroud 28. The semi-hexagonal end 36 of the counter coding pin 34 is complementary to the semi-hexagonal end 25 of the coding pin 22 and together they have a hexagonal cross-section that corresponds to that of open polygonal section 32 and to that of the intermediate section 24 of the coding pin 22.

Figure 4:
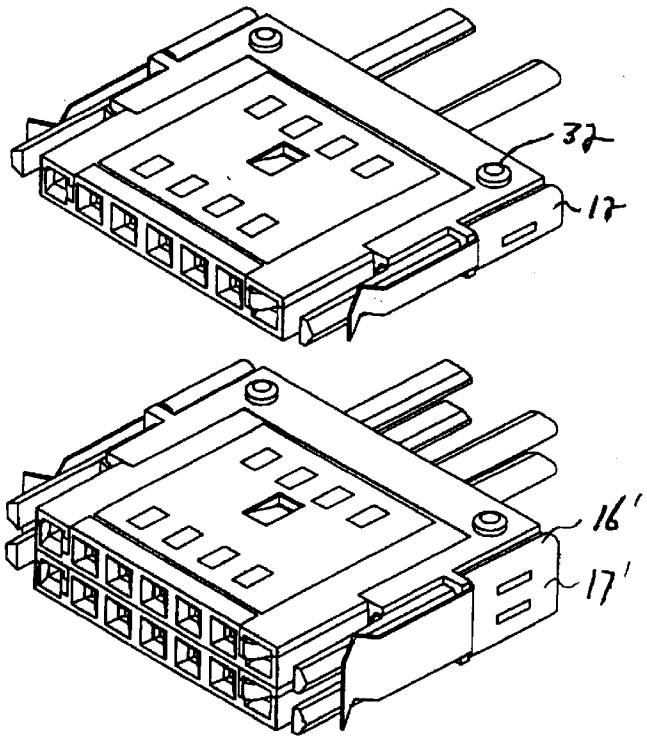
FIG. 4 shows an assembled cable connector comprising a single connector module as well as a cable connector comprising two connector modules.

FIG. 4 shows a cable connector comprising two end-to-end stackable connector modules which are provided with alignment protrusions 37 and corresponding notches (on their lower surface; not shown) which are joined together by means of two latches 17', one on each side of the cable connector. The twin guides 16' of these latches 17' are spaced apart by a distance which in this case roughly equals twice the height of the each of the connector modules or, in more general terms, the total height of all the connector modules comprised in the cable connector. Thus, the latches according to the present invention serve both as a means for establishing a connection with a connector counterpart and as a means for efficiently building different cable connectors from basic building blocks, such as the above-mentioned connector modules.

The coding pins according to a preferred embodiment of the present invention provide a stable guiding means for the cable connector during insertion into a counterpart, a coding means for avoiding mix-ups resulting in the connection of a cable connector to wrong counterpart positions, and a polarising means for avoiding upside down connections. Also, the number of coding options is very large, even with a small number of coding pins. Two of the above-described coding pins 22 in a cable connector comprising a single connector provide (in combination with counter coding pins 34) up to 36 coding options, whereas four coding pins 22, e.g. in a cable connector comprising two connector joined together by means of the latches described above, provide 1296 coding positions. Polarisation is guaranteed if at least one of the coding pins 22 is rotated with respect to the other coding pins and, in that case, all the mentioned coding options can be used.

Within the framework of the present invention, the term "polygonal" means as a polygon, preferably a regular polygon, with at least five straight or substantially straight sides and angles. Semi-polygons are preferred, since they enable a large number of permutations of the coding pins and provide ample guidance and mechanical strength.

As a matter of course, the present invention is not limited to the above described preferred embodiment and can be varied in a number of ways within the scope of the claims.

What is claimed is:

1. A cable connector comprising:

a housing of an electrically insulating material containing one or more contact elements, and one or more openings for accommodating a corresponding number of cables; and a means for establishing a connection to a counterpart, the means being soldered to a printed circuit board;

wherein, the means comprises a resilient latch which in turn comprises a guide with which the latch is fitted into or onto a complementary guide on the housing for mounting the latch to the housing, the latch being mounted to the housing by sliding the guide alongside of the housing within the complementary guide.

2. A cable connector according to claim 1, comprising a stack of at least two of said housings with said guide of said latch being fitted at least into or onto complementary guides on the outermost housings.

3. A cable connector according to claim 2, wherein said housings are positioned end-to-end.

4. A cable connector according to claim 1, comprising at least one coding pin which is sandwiched between said resilient latch and said housing.

5. A cable connector according to claim 4, wherein said housing comprises at least one cavity in which said coding pin is or can be placed, the cavity and one end or a section of said coding pin having corresponding cross-sections which enable placement of said coding pin in the cavity in one of a number of different positions.

6. A cable connector according to claim 5, wherein a top view of the other end of said coding pin is different for each of said positions.

7. A cable connector according to claim 5, wherein said housing comprises at least two of said cavities of which the cross-sections are staggered with respect to each other.

8. A cable connector according to claim 5, wherein said cross-section of one end or a section of said coding pin is polygonal, whereas the other end of said coding pin is semi-polygonal.

9. A cable connector according to claim 1, wherein said complementary guide is a groove.

10. A cable connector according to claim 1, wherein said complementary guide is a rail.

11. A kit comprising:

at least one housing of an electrically insulating material containing one or more cavities for accommodating a corresponding number of contact elements and one or more openings for accommodating a corresponding number of cables;

wherein, the kit comprises at least one resilient latch which in turn comprises a guide with which the latch can be fitted into or onto a complementary guide on the housing for mounting the latch to the housing, the latch being mounted in the housing by sliding the guide alongside of the housing within the complementary guide.

12. A kit according to claim 11, wherein said housings are stackable end-to-end.

13. A kit according to claim 11, wherein at least one of said housings comprises at least one coding pin sandwiched between said resilient latch and this housing, and furthermore comprises at least one cavity in which a coding pin is or can be placed, the cavity and one end or a section of the coding pin having corresponding cross-sections which enable placement of the coding pin in the cavity in one of a number different positions.

14. A kit according to claim 11, wherein said complementary guide is a groove.

15. A kit according to claim 11, wherein said complementary guide is a rail.

* * * * *